US012618610B2

(12) United States Patent
Takase et al.

(10) Patent No.: US 12,618,610 B2
(45) Date of Patent: May 5, 2026

(54) REFRIGERATOR

(71) Applicant: SAMSUNG ELECTRONICS CO., LTD., Suwon-si (KR)

(72) Inventors: Hitoshi Takase, Yokohama (JP); Ryota Aoki, Yokohama (JP); Tomohiko Matsuno, Yokohama (JP); Makoto Shibuya, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 185 days.

(21) Appl. No.: 18/414,688

(22) Filed: Jan. 17, 2024

(65) Prior Publication Data

US 2024/0151460 A1 May 9, 2024

Related U.S. Application Data

(63) Continuation of application No. PCT/KR2022/009264, filed on Jun. 28, 2022.

(30) Foreign Application Priority Data

Aug. 26, 2021 (JP) ..... 2021-137797

(51) Int. Cl.
*F25D 23/02* (2006.01)
*F25D 21/04* (2006.01)

(52) U.S. Cl.
CPC ..... *F25D 23/028* (2013.01); *F25D 21/04* (2013.01); *F25D 2201/10* (2013.01)

(58) Field of Classification Search
CPC .... F25D 23/028; F25D 21/04; F25D 2201/10; F25D 23/085; F25D 23/082
See application file for complete search history.

(56) References Cited

U.S. PATENT DOCUMENTS 10,443,921 B2 10/2019 Okazaki et al.
10,823,483 B1 11/2020 Baylor et al.
(Continued)

FOREIGN PATENT DOCUMENTS

CN 208704268 U 4/2019
JP 56-132582 10/1981
(Continued)

OTHER PUBLICATIONS

English language translation of JP2021025664. Translated Sep. 2025 (Year: 2021).*
(Continued)

*Primary Examiner* — Cassey D Bauer
(74) *Attorney, Agent, or Firm* — STAAS & HALSEY LLP

(57) ABSTRACT

A refrigerator comprising a cabinet, a door configured to open and close an opening of the cabinet, and an outside air heat inductor arrangeable inside the door to extend toward the cabinet from a front portion of the door. The outside air heat inductor includes a first heat transfer path forming member configured to transfer outside air heat from outside the refrigerator toward a surface of the cabinet, and a second heat transfer path forming member arrangeable between the first heat transfer path forming member and an inside of the cabinet such that while the second heat transfer path forming member is arranged between the first heat transfer path forming member and the inside of the cabinet, the second heat transfer path forming member receives the outside air heat and prevents cold air within the cabinet from being transferred to the first heat transfer path forming member.

15 Claims, 7 Drawing Sheets

(56) References Cited

U.S. PATENT DOCUMENTS

| | | | |
|---|---|---|---|
| 10,866,021 | B2 | 12/2020 | Okazaki et al. |
| 11,029,075 | B2 | 6/2021 | Yi et al. |

FOREIGN PATENT DOCUMENTS

| | | | | |
|---|---|---|---|---|
| JP | 6-68429 | | 3/1994 | |
| JP | 2000-213853 | | 8/2000 | |
| JP | 2001-116437 | | 4/2001 | |
| JP | 2002-243348 | | 8/2002 | |
| JP | 2002-364978 | | 12/2002 | |
| JP | 2003-65652 | | 3/2003 | |
| JP | 2005-24204 | | 1/2005 | |
| JP | 2005-180720 | | 7/2005 | |
| JP | 2005-201524 | | 7/2005 | |
| JP | 2007-24348 | | 2/2007 | |
| JP | 2009-85454 | | 4/2009 | |
| JP | 2011-237115 | | 11/2011 | |
| JP | 2012-154564 | | 8/2012 | |
| JP | 5714303 | | 3/2015 | |
| JP | 2017-20711 | | 1/2017 | |
| JP | 2017-142051 | | 8/2017 | |
| JP | 2017-180875 | | 10/2017 | |
| JP | 2018-44758 | | 3/2018 | |
| JP | WO2018/181439 | | 10/2018 | |
| JP | 2019-49389 | | 3/2019 | |
| JP | 6559335 | | 7/2019 | |
| JP | 2020-125889 | | 8/2020 | |
| JP | 2020-153602 | | 9/2020 | |
| JP | 2021025664 | A * | 2/2021 | ..... F25D 11/02 |
| JP | 7027166 | | 3/2022 | |
| JP | 7186549 | | 12/2022 | |
| KR | 10-1348602 | | 1/2014 | |
| KR | 10-1802586 | | 11/2017 | |
| KR | 10-2021-0078841 | | 6/2021 | |

OTHER PUBLICATIONS

PCT/ISA/210 dated Sep. 22, 2022 in International Patent Application No. PCT/KR2022/009264.

PCT/ISA/220 and PCT/ISA/237 dated Sep. 22, 2022 in International Patent Application No. PCT/KR2022/009264.

* cited by examiner

REFRIGERATOR

CROSS-REFERENCE TO RELATED APPLICATIONS

This application is a continuation application, under 35 U.S.C. § 111 (a), of international application No. PCT/KR2022/009264, filed Jun. 28, 2022, which claims priority under 35 U. S. C. § 119 to Japanese Patent Application No. 2021-137797, filed Aug. 26, 2021, the disclosures of which are incorporated by reference herein in their entireties.

TECHNICAL FIELD

The disclosure relates to refrigerators.

BACKGROUND ART

A problem with refrigerators is that an edge of an opening near a door gasket tends to become cold, and condensation occurs when outside air comes in contact with that portion (hereinafter referred to as the condensation generating portion).

According to Patent Document 1 (Japanese Patent Application Publication No. 2009-85454), condensation is prevented by heating the condensation generating portion by supplying electricity to a condensation prevention heater and generating heat, or by flowing a refrigerant on the high pressure side of a refrigeration cycle to heat a partition portion near the condensation generating portion to heat a partition portion.

In order to prevent condensation without using a heater or hot pipe, in Patent Document 2 (Japanese Patent Laid-Open No. 2005-24204), a heat conductive material is arranged between a door and a cabinet to transfer heat from outside air to the condensation generating portion.

DISCLOSURE

Technical Solution

A refrigerator according to an aspect of the disclosure includes a cabinet, a door configured to open and close an opening of the cabinet, an outside air heat inductor arrangeable inside the door to extend toward the cabinet from a front portion of the door, wherein the outside air heat inductor includes a first heat transfer path forming member configured to transfer outside air heat from outside the refrigerator toward a surface of the cabinet, and a second heat transfer path forming member arrangeable between the first heat transfer path forming member and an inside of the cabinet such that while the second heat transfer path forming member is arranged between the first heat transfer path forming member and the inside of the cabinet, the second heat transfer path forming member receives the outside air heat and prevents cold air within the cabinet from being transferred to the first heat transfer path forming member.

As an embodiment, the first heat transfer path forming member and the second heat transfer path forming member may be inside the door and extend toward the cabinet from the front portion of the door.

As an embodiment, at least one of an upper surface portion and a lower surface portion of the door may include a decorative panel, and the first heat transfer path forming member may be in contact with an inner surface of the decorative panel.

As an embodiment, an end of the second heat transfer path forming member near the inside of the cabinet may be located between the inside of the cabinet and the first heat transfer path forming member.

As an embodiment, the outside air heat inductor further may include one or more third heat transfer path forming members arrangeable between the first heat transfer path forming member and the second heat transfer path forming member to extend toward the cabinet from the front portion of the door.

As an embodiment, the outside air heat inductor further may include an intermediate support member interposed between the first heat transfer path forming member and the second heat transfer path forming member and supporting the first heat transfer path forming member and the second heat transfer path forming member. As an embodiment, the outside air heat inductor may include a fourth heat transfer path forming member covering at least a portion of surfaces of the intermediate support member other than surfaces on which the first heat transfer path forming member and the second heat transfer path forming member are supported.

As an embodiment, at least one of an upper surface portion and a lower surface portion of the door may include a decorative panel, the first heat transfer path forming member may be in contact with an inner surface of the decorative panel, and thermal conductivities of the first heat transfer path forming member and the second heat transfer path forming member may be higher than a thermal conductivity of the decorative panel.

As an embodiment, thicknesses of the first heat transfer path forming member and thicknesses of the second heat transfer path forming member may be 10 μm or more and 5 mm or less.

As an embodiment, a resin passing hole through which foamed resin filling the door passes may be in the second heat transfer path forming member, and the foamed resin may fill between the first heat transfer path forming member and the second heat transfer path forming member.

As an embodiment, the first heat transfer path forming member and the second heat transfer path forming member may be integrally formed. As an embodiment, the refrigerator may further include a connection member to connect the first heat transfer path forming member with the second heat transfer path forming member, wherein the connection member connects ends of the first heat transfer path forming member and the second heat transfer path forming member near the front portion of the door.

As an embodiment, the outside air heat inductor may include a plurality of division elements arrangeable to be spaced apart from each other along a width direction of the door.

As an embodiment, an outward-facing surface of the outside air heat inductor may have a shape according to the front portion of the door, and an inward-facing surface of the outside air heat inductor may have a shape according to a door liner of the door facing the cabinet.

As an embodiment, an air layer may be between the first heat transfer path forming member and the second heat transfer path forming member.

According to embodiments of the refrigerator described above, sufficient outside air heat may be transferred to a surface of the cabinet, so that occurrence of condensation may be prevented or reduced. A heater or hot pipe for preventing condensation may be omitted, thereby reducing manufacturing costs.

BEST MODE

Mode for Invention

Figure 1:
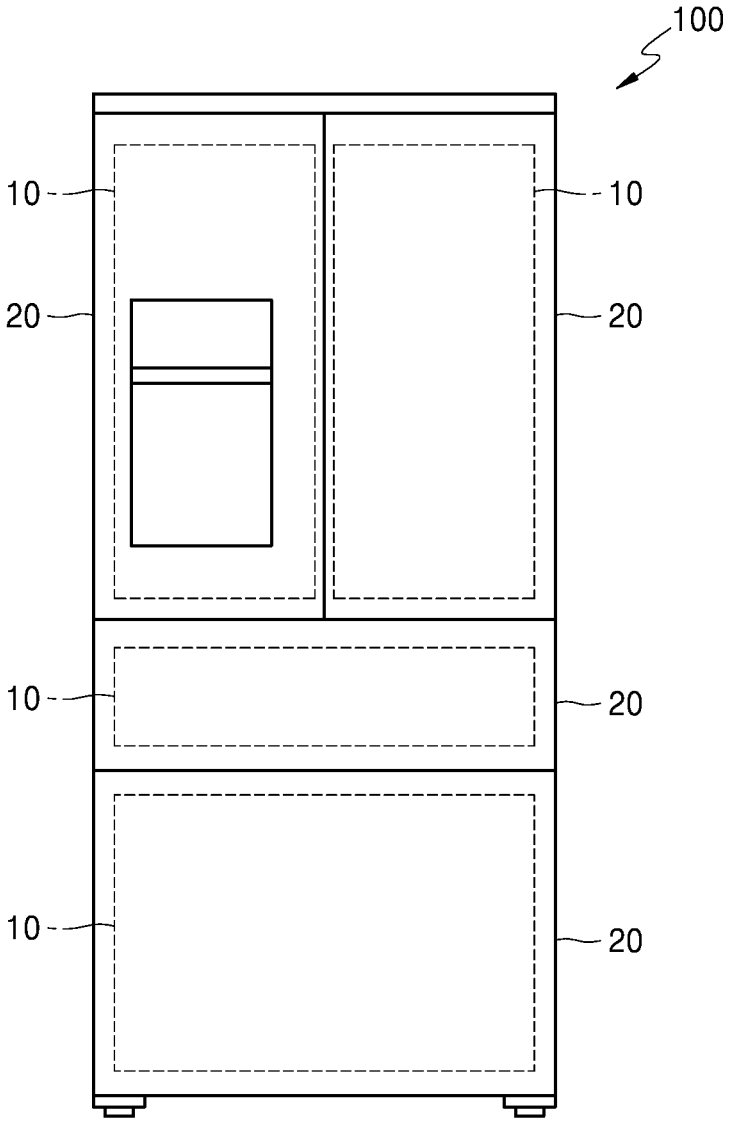
FIG. 1 is a schematic diagram of an embodiment of a refrigerator.

All terms including descriptive or technical terms which are used herein should be construed as having meanings that are obvious to one of ordinary skill in the art. However, the terms may have different meanings according to the intention of one of ordinary skill in the art, precedent cases, or the appearance of new technologies. Also, some terms may be arbitrarily selected by the applicant, and in this case, the meaning of the selected terms will be described in detail in the detailed description of the disclosure. Thus, the terms used herein have to be defined based on the meaning of the terms together with the description throughout the specification. When a part "includes" or "comprises" an element, unless there is a particular description contrary thereto, the part may further include other elements, not excluding the other elements.

Hereinafter, embodiments of the disclosure will be described in detail with reference to the accompanying drawings such that one of ordinary skill in the art may easily implement the disclosure. However, the disclosure may be implemented in various different forms and is not limited to the embodiments described herein. Also, in the drawings, parts irrelevant to the description are omitted in order to clearly describe the disclosure, and like reference numerals designate like elements throughout the specification. Hereinafter, embodiments of a refrigerator according to the disclosure are described with reference to drawings.

According to a configuration in which a heater or hot pipe is installed to prevent condensation, other problems such as an increase in cost due to an increase in the number of components or an increase in power consumption when using the heater may occur. In a structure of transferring outside air heat to the condensation generating portion by using a thermally conductive material between a door and a cabinet, the cold air inside the refrigerator may be transmitted to the thermally conductive material, resulting in an insufficient amount of heat that may be transferred to the condensation generating portion through the thermally conductive material. Therefore, it may be difficult to reliably prevent condensation solely by placing the thermally conductive material between the door and the cabinet. The disclosure provides a refrigerator in which sufficient heat may be transferred to a surface of the cabinet to prevent condensation without using a heater or hot pipe.

Figure 2:
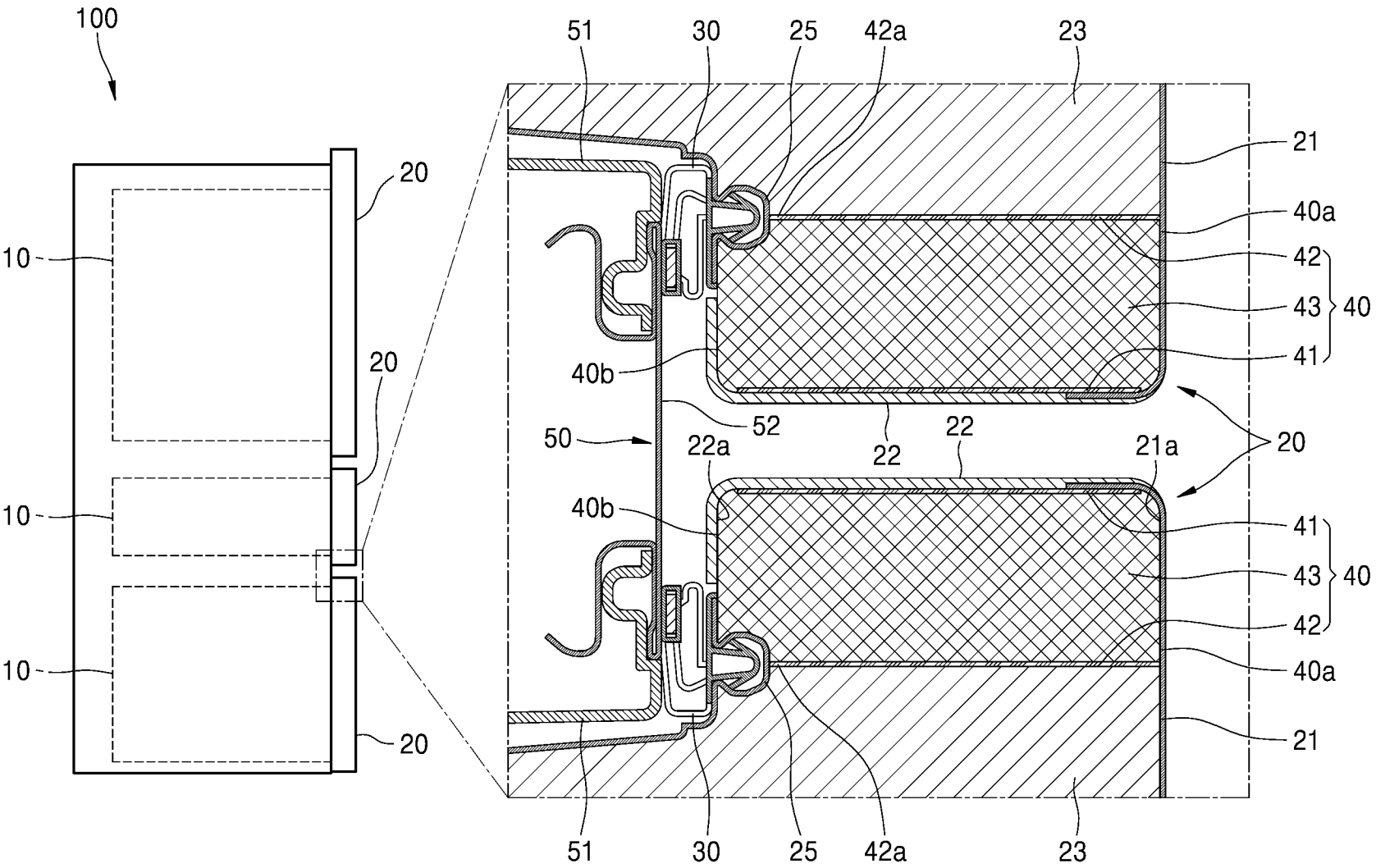
FIG. 2 is a cross-sectional view of an embodiment of an outside air heat inductor.

FIG. 1 is a schematic diagram of a refrigerator 100 according to an embodiment of the disclosure. FIG. 2 is a cross-sectional view of an embodiment of an outside air heat inductor 40. Referring to FIGS. 1 and 2, the refrigerator 100 according to an embodiment of the disclosure may include a cabinet 10 and a door 20 installed on the cabinet 10. The refrigerator 100 of the present embodiment may include a plurality of cabinets 10 and a plurality of doors 20 respectively installed for the plurality of cabinets 10. The plurality of cabinets 10 may be formed by dividing an internal space of the refrigerator 100 in a vertical and/or horizontal directions. The plurality of cabinets 10 may include, for example, a refrigerator compartment, a freezer compartment, a vegetable compartment, and ice-making compartment, etc. The internal space of the refrigerator 100 may be divided into the plurality of cabinets 10 by a partition, for example, a partition 50. The plurality of cabinets 10 may be, for example, box-shaped with an opening. The plurality of cabinets 10 may be in the form of a box that is long in the vertical direction or in the shape of a box that is long in the horizontal direction. For example, the plurality of cabinets 10 may have a box shape with one side open. The plurality of doors 20 open and close the open surfaces of the plurality of cabinets 10. The plurality of doors 20 may be, for example, sliding or hinged, or may be single-door or double-door. The partition 50 may include an inner wall 51 forming the inner surface of the cabinet 10 and an outer wall 52 forming the outer surface of the cabinet 10.

Referring to FIG. 2, at least a front portion 21 of the door 20 according to an embodiment may be formed of a metal plate. In the present embodiment, upper and lower surface portions of the door 20 may include a decorative panel 22 formed of resin. The inside of the door 20 may be filled with foamed resin 23.

A sealing member 30 is interposed between the door 20 and the cabinet 10. As shown in FIG. 2, the sealing member 30 is interposed between the cabinet 10 and the door 20 to seal the inside of the cabinet 10 in a state in which the opening of the cabinet 10 is closed by the door 20. As an example, the sealing member 30 may be a gasket including a magnet. The sealing member 30 is mounted on the inner surface of the door 20 and, when the door 20 is closed, may be attached to the outer surface of the cabinet 10, that is, to the outer wall 52 of the partition 50 by magnetic force.

As shown in FIG. 2, the refrigerator 100 according to an embodiment may include an outside air heat inductor 40 for transferring outside air heat to a surface of the cabinet 10, for example, the outer wall 52 of the partition 50. The outside air heat inductor 40 may be installed on the door 20. The outside air heat inductor 40 may be installed inside the door 20 to extend from the outside to the inside. Here, "outside" refers to the front portion 21 side, and "inside" refers to the cabinet 10 side.

As shown in FIG. 2, the outside air heat inductor 40 according to an embodiment may include a first heat transfer path forming member 41 and a second heat transfer path forming member 42, which form a heat transfer path of outside air heat. The outside air heat inductor 40 according to an embodiment may further include an intermediate support member 43 interposed between the first and second heat transfer path forming members 41 and 42. The outside air heat inductor 40 according to an embodiment extends from the outside to the inside of door 20. In other words, an outward-facing surface (or end) 40*a* of the outside air heat inductor 40 may be in contact with or positioned close to the front portion 21 of the door 20, for example, an inside 21*a* of the metal plate, and an inside of the outside air heat inductor 40, that is, a surface (or end) 40*b* facing the cabinet 10 may be in contact with or positioned close to a rear surface portion of the door 20, that is, an inside 22*a* of an inner wall of the door 20 close to the cabinet 10 of the door 20.

The outside air heat inductor 40 may be in contact with the door 20, for example an inner surface of the decorative panel 22 forming upper and lower surface portions of the door 20. For example, the first heat transfer path forming member 41 may be installed to contact the inner surface of the decorative panel 22. The first heat transfer path forming member 41 extends from the outside to the inside and transports outside air heat to a surface or near the surface of the cabinet 10, for example, to the outer wall 52 of the partition 50 or near the outer wall 52 of the partition 50. The first heat transfer path forming member 41 may have at least a higher thermal conductivity than the decorative panel 22. For example, the thermal conductivity of the first heat transfer path forming member 41 may be 200 mW/(m·k) or more. The first heat transfer path forming member 41 may be formed of metal with a thermal conductivity of 200 mW/(mk) or more. In the present embodiment, the first heat transfer path forming member 41 extends in the horizontal direction from the outside to the inside. As an embodiment, the first heat transfer path forming member 41 may be, for example, a metal foil, metal plate, or metal film with a thickness of 10 μm or more and 5 mm or less. For example, the first heat transfer path forming member 41 may be an aluminum tape. The first heat transfer path forming member 41 may, for example, extend obliquely with respect to the horizontal direction, and a thickness or material thereof is not limited to the examples described above.

The second heat transfer path forming member 42 extends from the outside to the inside of the door 20. In the present embodiment, the second heat transfer path forming member 42 is a separate member from the first heat transfer path forming member 41. The second heat transfer path forming member 42 is installed closer to the inside of the refrigerator 100, that is, to the inside of the cabinet 10, than the first heat transfer path forming member 41 described above. In other words, inside the door 20, the second heat transfer path forming member 42 is located between the inside of the cabinet 10 and the first heat transfer path forming member 41. In other words, inside the door 20, the second heat transfer path forming member 42 is located between the inner wall 51 of the partition 50 and the first heat transfer path forming member 41. The second heat transfer path 42 prevents cold air inside the cabinet 10 from being transferred to the first heat transfer path forming member 41 by receiving heat from outside air. The second heat transfer path forming member 42 may have at least a higher thermal conductivity than the decorative panel 22. For example, the thermal conductivity of the second heat transfer path forming member 42 may be 200 mW/(m·k) or more. The second heat transfer path forming member 42 may be formed of metal with a thermal conductivity of 200 mW/(m·k) or more. In the present embodiment, the second heat transfer path forming member 42 extends in the horizontal direction from the outside to the inside. As an embodiment, the second heat transfer path forming member 42 may be, for example, a metal foil, metal plate, or metal film with a thickness of 10 μm or more and 5 mm or less. For example, the second heat transfer path forming member 42 may be an aluminum tape. For example, the second heat transfer path forming member 42 may extend obliquely with respect to the horizontal direction, and a thickness or material thereof is not limited to the examples described above. The material or thermal conductivity of the second heat transfer path forming member 42 is not necessarily the same as that of the first heat transfer path forming member 41.

As described above, the interior of the refrigerator 100 of the present embodiment is divided into the plurality of cabinets 10 by the partition 50, as shown in FIG. 2. At least an inner end 42*a* of the second heat transfer path forming member 42 is positioned closer to the first heat transfer path forming member 41 than the inner wall 51 forming the inner surface of the cabinet 10 in the partition 50. In other words, at least the inner end 42*a* of the second heat transfer path forming member 42 is located between the inner wall 51 forming the inner surface of the cabinet 10 in the partition 50 and the first heat transfer path forming member 41.

In the present embodiment, the second heat transfer path forming member 42 extends in the horizontal direction, as described above, whereby the entire second heat transfer path forming member 42 is located closer to the first heat transfer path forming member 41 than the inner wall 51 of the partition 50. In other words, the second heat transfer path forming member 42 is located between the inner wall 51 forming the inner surface of the cabinet 10 in the partition 50 and the first heat transfer path forming member 41.

The intermediate support member 43 may be interposed between the first heat transfer path forming member 41 and the second heat transfer path forming member 42 to support the first and second heat transfer path forming members 41 and 42. The intermediate support member 43 is not deformed when the foamed resin 23 filling the inside the door 20 is foamed, and supports the first heat transfer path forming member 41 and the second heat transfer path forming member 42. In other words, the intermediate support member 43 has a rigidity that is not deformed by foaming pressure of the foamed resin 23. The intermediate support member 43 may be formed of, for example, resin. In the present embodiment, the intermediate support member 43 is formed of expanded Styrofoam.

Figure 3:
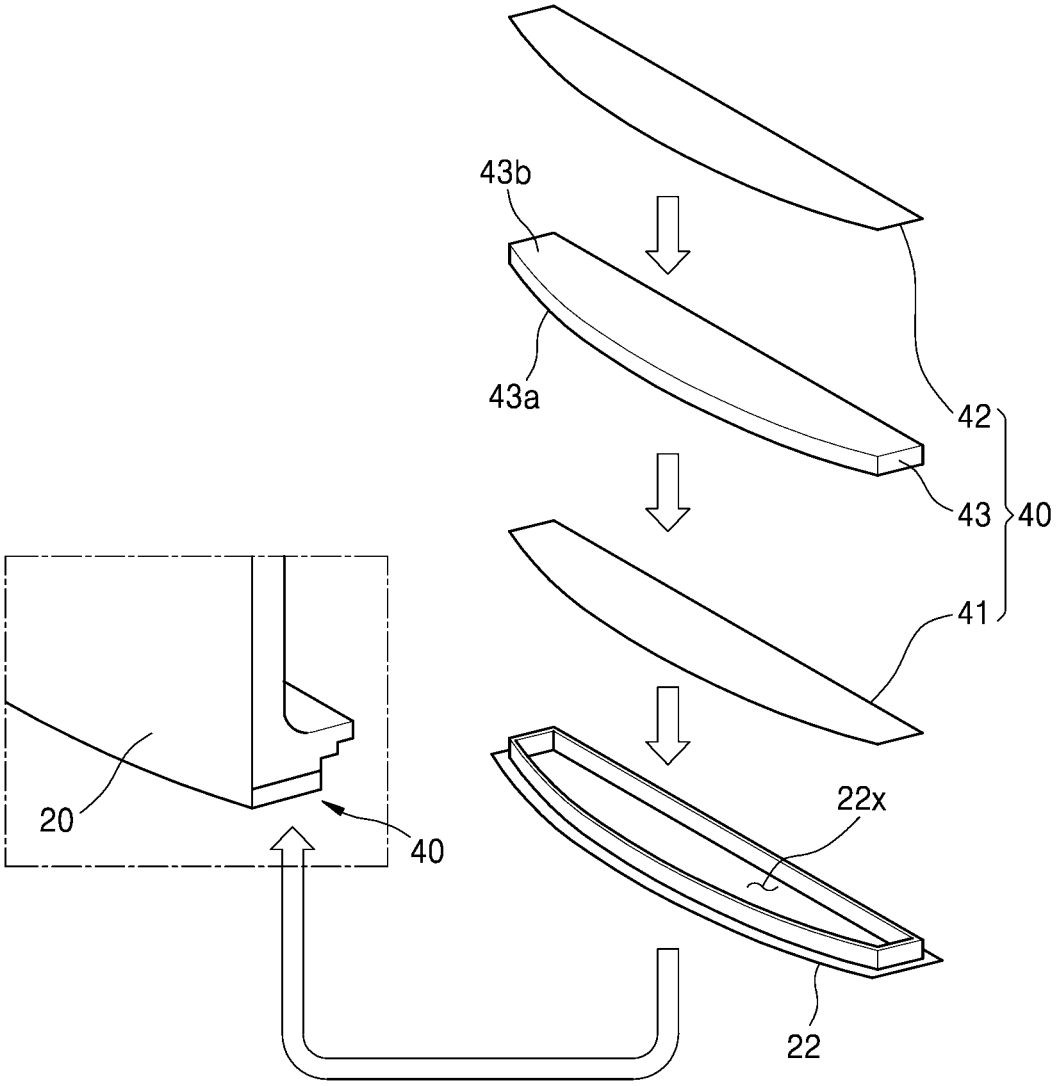
FIG. 3 is an exploded perspective view of an embodiment of an outside air heat inductor.

FIG. 3 is an exploded perspective view of an embodiment of the outside air heat inductor 40. Referring to FIG. 3, the outside air heat inductor 40 may be manufactured by attaching the first heat transfer forming member 41 in the form of an aluminum tape to one side 43*a* of the intermediate support member 43 and attaching the second heat transfer path forming member 42 in the form of an aluminum tape to an opposite side 43*b* of the intermediate support member 43. After attaching the outside air heat inductor 40 to an attachment recess 22*x* provided in the decorative panel 22, the decorative panel 22 is attached to the front portion 21 partially extending to the upper and lower surfaces as shown in FIG. 2, and the inside of the door 20 is filled with the foamed resin 23, so that the door 20 according to an embodiment may be formed.

Figure 4:
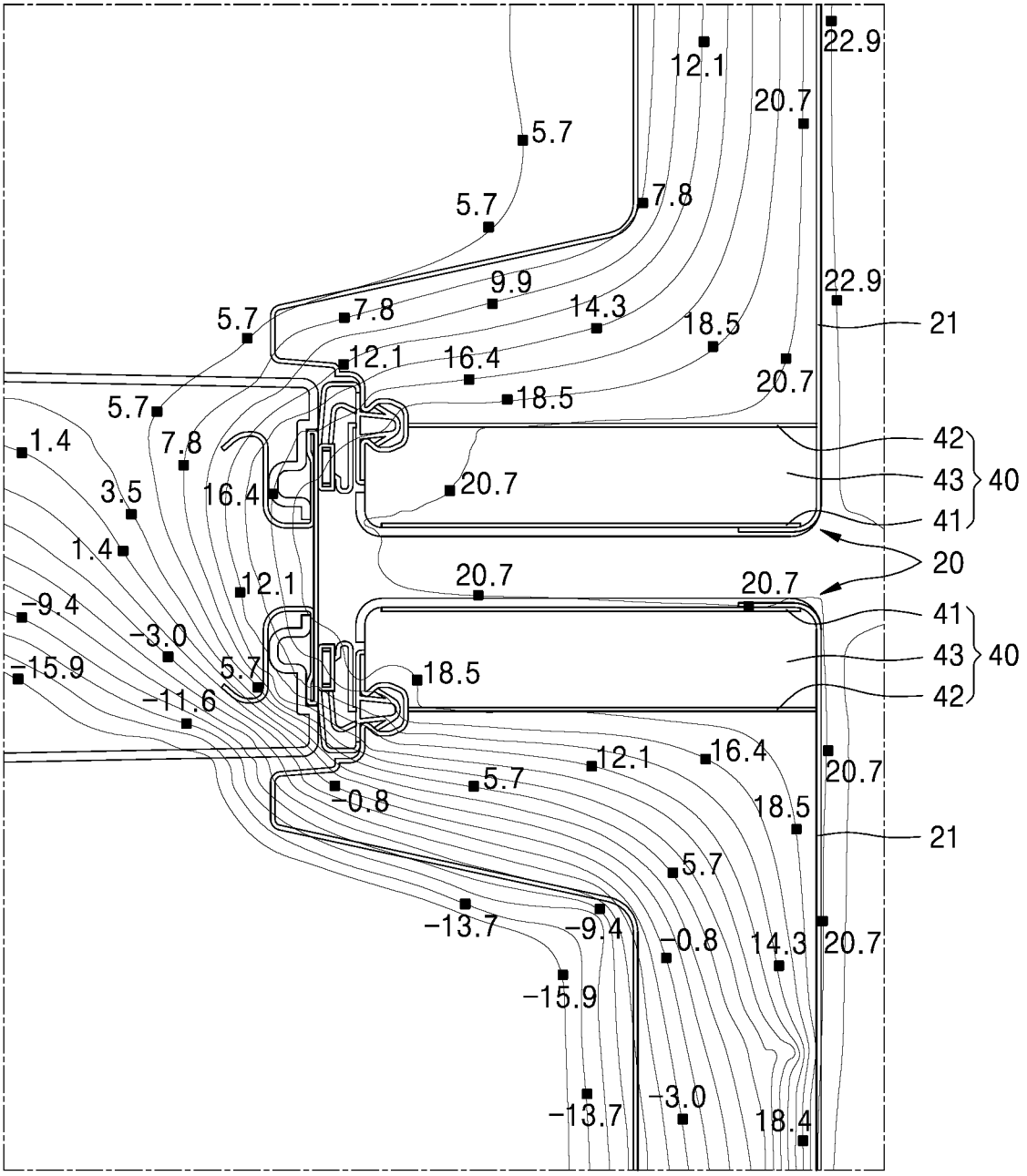
FIG. 4 is experimental data showing an effect of an embodiment of an outside air heat inductor.

According to an embodiment of the refrigerator 100, the outside air heat inductor 40 includes not only the first heat transfer path forming member 41, but also the second heat transfer path forming member 42 installed at a location closer to the inside of the cabinet 10 than the first heat transfer path forming member 41. The second heat transfer path forming member 42 receives outside air heat and serves to prevent cold air inside the cabinet 10 from being transferred to the first heat transfer path forming member 41. FIG. 4 is experimental data showing an operational effect of an embodiment of the outside air heat inductor 40. In FIG. 4, the curves indicate isotherms, and each of the isotherms is indicated with a temperature. Referring to FIG. 4, the temperature inside the cabinet 10 is about −16 degrees of centigrade. This cold air is blocked by the second heat transfer path forming member 42 that has absorbed outside air heat and is prevented from being transmitted to the first heat transfer path forming member 41. As a result, sufficient outside air heat may be transferred to a surface of the cabinet 10, for example, the outer wall 52 of the partition 50, by the first heat transfer path forming member 41, making it possible to effectively prevent condensation. In addition, because the outside air heat inductor 40, for example, the first heat transfer path forming member 41, is in contact with the inner surface of the decorative panel 22, outside air heat may be effectively transmitted to a portion of a surface of the cabinet 10 where condensation is likely to occur. In addition, because the outside air heat inductor 40 is installed inside the door 20 from the outside to the inside, outside air heat may be more clearly transferred to a surface of the cabinet 10, for example, the outer wall 52 of the partition 50.

Furthermore, because the second heat transfer path forming member 42 is located closer to the first heat transfer path forming member 41 than the inner wall 51 forming the inside of the cabinet 10 in the partition 50, cold air inside the cabinet 10 may be more reliably prevented from being transferred to the first heat transfer path forming member 41. Furthermore, because the first heat transfer path forming member 41 and the second heat transfer path forming member 42 are supported by the intermediate support member 43, the first heat transfer path forming member 41, the second heat transfer path forming member 42, and the intermediate support member 43 may be integrated. An assembly in which the first heat transfer path forming member 41, the second heat transfer path forming member 42, and the intermediate support member 43 are integrated may be installed inside the door 20. Accordingly, damage to the outside air heat inductor 40 and displacement of the outside air heat inductor 40 may be prevented, thereby ensuring manufacturability of the refrigerator 100.

Figure 5:
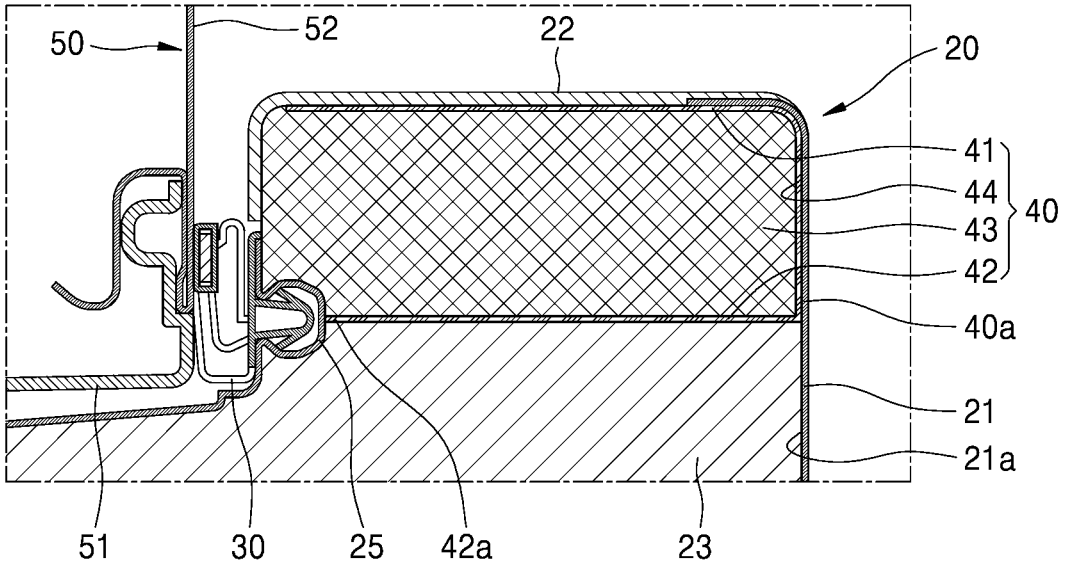
FIG. 5 is a cross-sectional view of an embodiment of an outside air heat inductor.

In the embodiment described above, the first heat transfer path forming member 41 and the second heat transfer path forming member 42 are separate members, but the outside air heat inductor 40 is not limited to the embodiment described above, FIG. 5 is a cross-sectional view of an embodiment of the outside air heat inductor 40. Referring to FIG. 5, the first heat transfer path forming member 41 and the second heat transfer path forming member 42 may be formed integrally. In this case, the outside air heat inductor 40 may include a connection member 44, which is installed between the first heat transfer path forming member 41 and the second heat transfer path forming member 42 to connect the first heat transfer path forming member 41 with the second heat transfer path forming member 42. The connection member 44 may connect ends of the first heat transfer path forming member 41 and the second heat transfer path forming member 42 adjacent to the front portion 21 of the door 20. The connection member 44 may be installed along the inside 21*a* of the front portion 21 of the door 20. For example, one metal plate may be folded into a "U" shape to form the first heat transfer path forming member 41, the connection member 44, and the second heat transfer path forming member 42 integrally. In addition, because the connection member 44 is located adjacent to the front portion 21, outside air heat may be effectively absorbed from the front portion 21 formed of a metal plate and transferred to the first and second heat transfer path forming members 41 and 42. As shown in FIG. 5, the first heat transfer path forming member 41, the connection member 44, and the second heat transfer path forming member 42 may be supported by the intermediate support member 43. According to the integrated first heat transfer path forming member 41, connection member 44, and second heat transfer path forming member 42, the intermediate support member 43 may be omitted. Accordingly, the number of components may be reduced, thereby reducing manufacturing costs and components costs.

Figure 6:
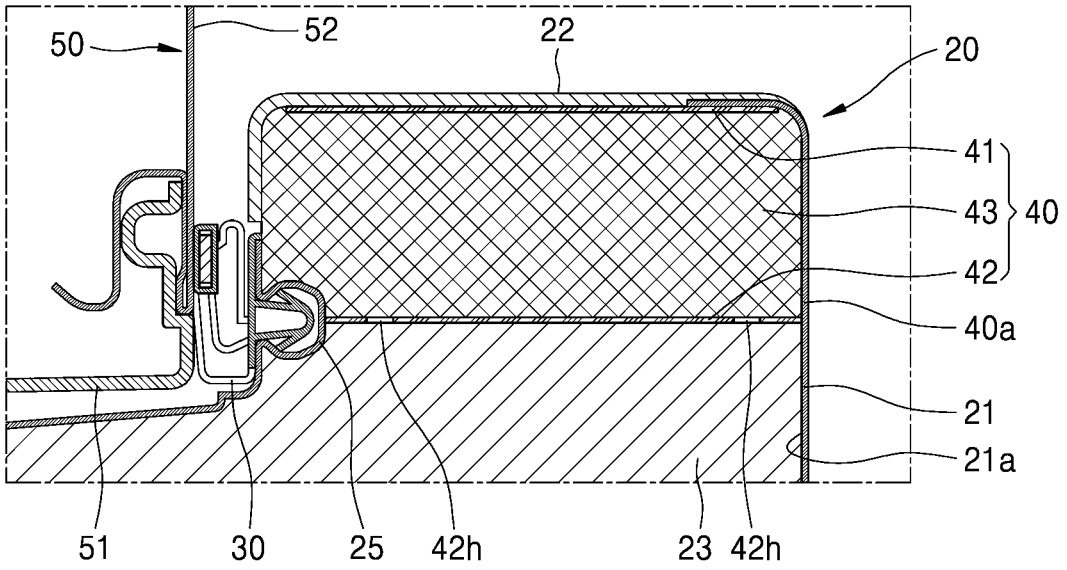
FIG. 6 is a cross-sectional view of an embodiment of an outside air heat inductor.

FIG. 6 is a cross-sectional view of an embodiment of the outside air heat inductor 40. Referring to FIG. 6, a resin passing hole 42*h* may be provided in the second heat transfer path forming member 42 so that the foamed resin 23 filling inside the door 20 may pass through the hole. The resin passing hole 42*h* may be provided in plurality. When the inside of the door 20 is filled with the foamed resin 23, the foamed resin 23 may pass through the resin passing hole 42*h* and fill between the first heat transfer path forming member 41 and the second heat transfer path forming member 42. The intermediate support member 43 may be formed by the filled foamed resin 23.

Figure 7:
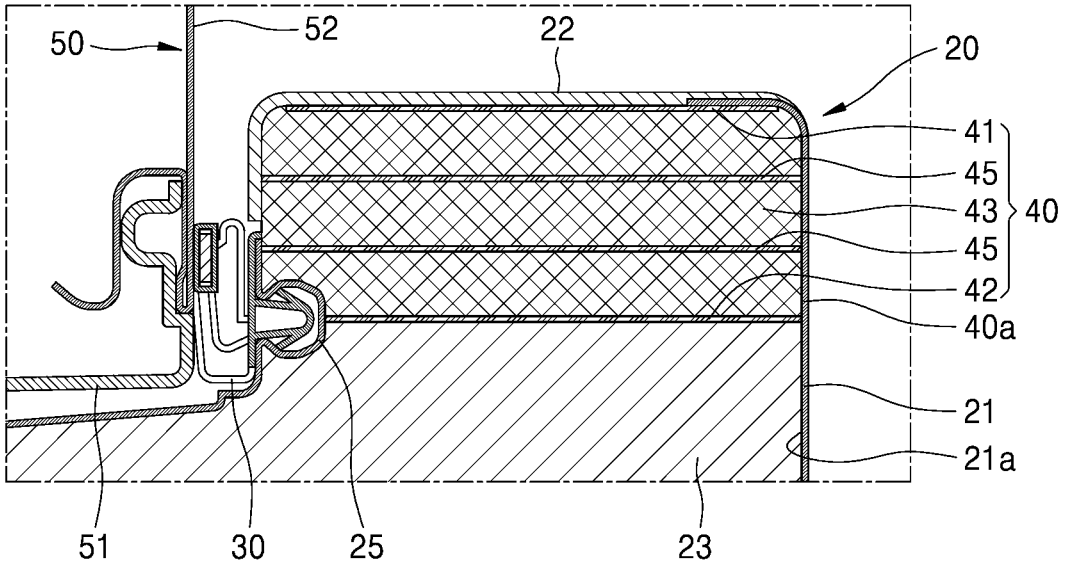
FIG. 7 is a cross-sectional view of an embodiment of an outside air heat inductor.

FIG. 7 is a cross-sectional view of an embodiment of the outside air heat inductor 40. Referring to FIG. 7, the outside air heat inductor 40 may further include a third heat transfer path forming member 45 installed between the first heat transfer path forming member 41 and the second heat transfer path forming member 42. The third heat transfer path forming member 45 may extend from the outside of the door 20 to the inside of the door 20. The third heat transfer path forming member 45 may be provided in plurality. In this case, the plurality of third heat transfer path forming member 45 may be arranged spaced apart from each other between the first heat transfer path forming member 41 and the second heat transfer path forming member 42. A plurality of intermediate support member 43 may be interposed between the first heat transfer path forming member 41, the second heat transfer path forming member 42, and the third heat transfer path forming member 45.

The third heat transfer path forming member 45 may extend from the outside to the inside of the door 20. The third heat transfer path forming member 45 may have at least a higher thermal conductivity than the decorative panel 22. For example, the thermal conductivity of the third heat transfer path forming member 45 may be 200 mW/(m·k) or more. The third heat transfer path forming member 45 may be formed of metal with a thermal conductivity of 200 mW/(m·k) or more. In the present embodiment, the third heat transfer path forming member 45 may extend in the horizontal direction from the outside to the inside. As an embodiment, the third heat transfer path forming member 45 may be, for example, a metal foil, metal plate, or metal film with a thickness of 10 μm or more and 5 mm or less. For example, the third heat transfer path forming member 45 may be an aluminum tape. For example, the third heat transfer path forming member 45 may extend obliquely with respect to the horizontal direction, and a thickness or material thereof is not limited to the examples described above. The material or thermal conductivity of the third heat transfer path forming member 45 is not necessarily the same as that of the first heat transfer path forming member 41.

The third heat transfer path forming member 45, together with the second heat transfer path forming member 42, may prevent cold air inside the cabinet 10 from being transferred to the first heat transfer path forming member 41. In addition, the third heat transfer path forming member 45 may transfer outside air heat to a surface of the cabinet 10 together with the first heat transfer path forming member 41.

Figure 8:
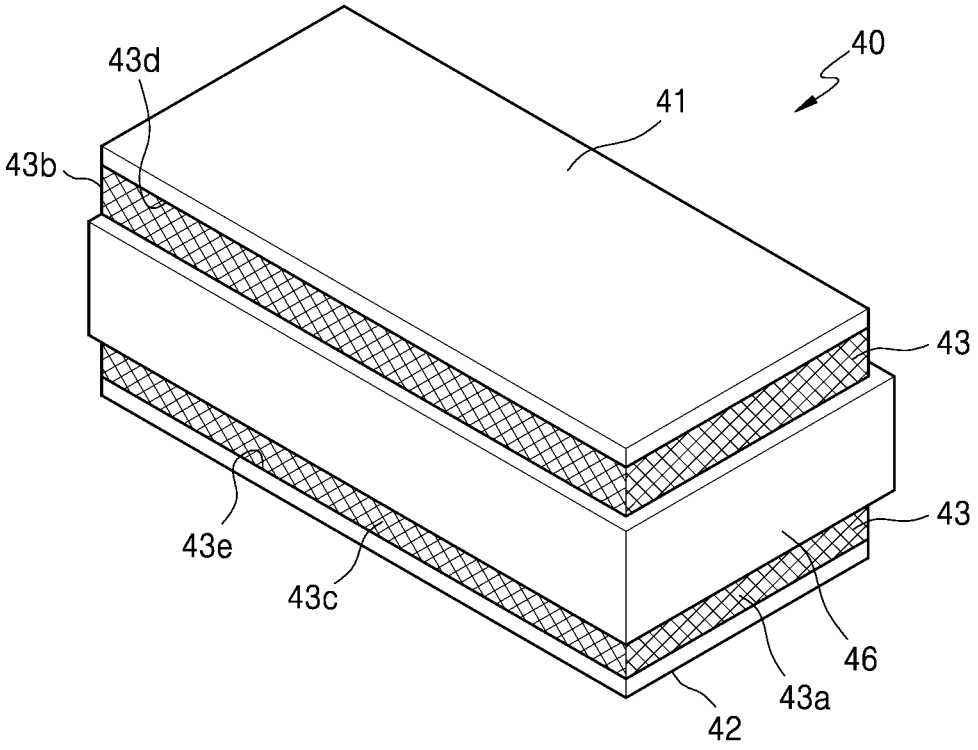
FIG. 8 is a schematic perspective view of an embodiment of an outside air heat inductor.

FIG. 8 is a schematic perspective view of an embodiment of the outside air heat inductor 40. Referring to FIG. 8, the outside air heat inductor 40 may further include a fourth heat transfer path forming member 46 covering the intermediate support member 43, separately from the first heat transfer path forming member 41 and the second heat transfer path forming member 42. The fourth heat transfer path forming member 46 may cover at least some of surfaces of the intermediate support member 43 other than surfaces on which the first and second heat transfer path forming members 41 and 42 are supported. In the present embodiment, the first heat transfer path forming member 41 and the second heat transfer path forming member 42 cover an upper surface 43*d* and a lower surface 43*e* of the intermediate support member 43, respectively. The fourth heat transfer path forming member 46 may cover all or part of front 43*a*, rear 43*b*, and side surfaces 43*c* of the intermediate support member 43. The front surface 43*a* of the intermediate support member 43 may be, for example, a surface facing the front portion 21 of the door 20. The rear surface 43*b* of the intermediate support member 43 may be a surface facing the front surface 43*a* in the horizontal direction. The side surface 43*c* of the intermediate support member 43 may be a surface extending in the horizontal direction and connecting the front surface 43*a* with the rear surface 43*b*.

A thermal conductivity of the fourth heat transfer path forming member 46 is not particularly limited. For example, the fourth heat transfer path forming member 46 may have at least a higher thermal conductivity than the decorative panel 22. For example, the thermal conductivity of the fourth heat transfer path forming member 46 may be 200 mW/(m·k) or more. The fourth heat transfer path forming member 46 may be formed of metal with a thermal conductivity of 200 mW/(m·k) or more. As an embodiment, the fourth heat transfer path forming member 46 may be, for example, a metal foil, metal plate, or metal film with a thickness of 10 μm or more and 5 mm or less. For example, the fourth heat transfer path forming member 46 may be an aluminum tape. A thickness or material of the fourth heat transfer path forming member 46 is not limited to the examples described above. The material or thermal conductivity of the fourth heat transfer path forming member 46 is not necessarily the same as that of the first heat transfer path forming member 41. According to this configuration, outside air heat may be efficiently transferred to a surface of the cabinet 50 not only through the first heat transfer path forming member 41 and the second heat transfer path forming member 42, but also through the fourth heat transfer path forming member 46.

Figure 9:
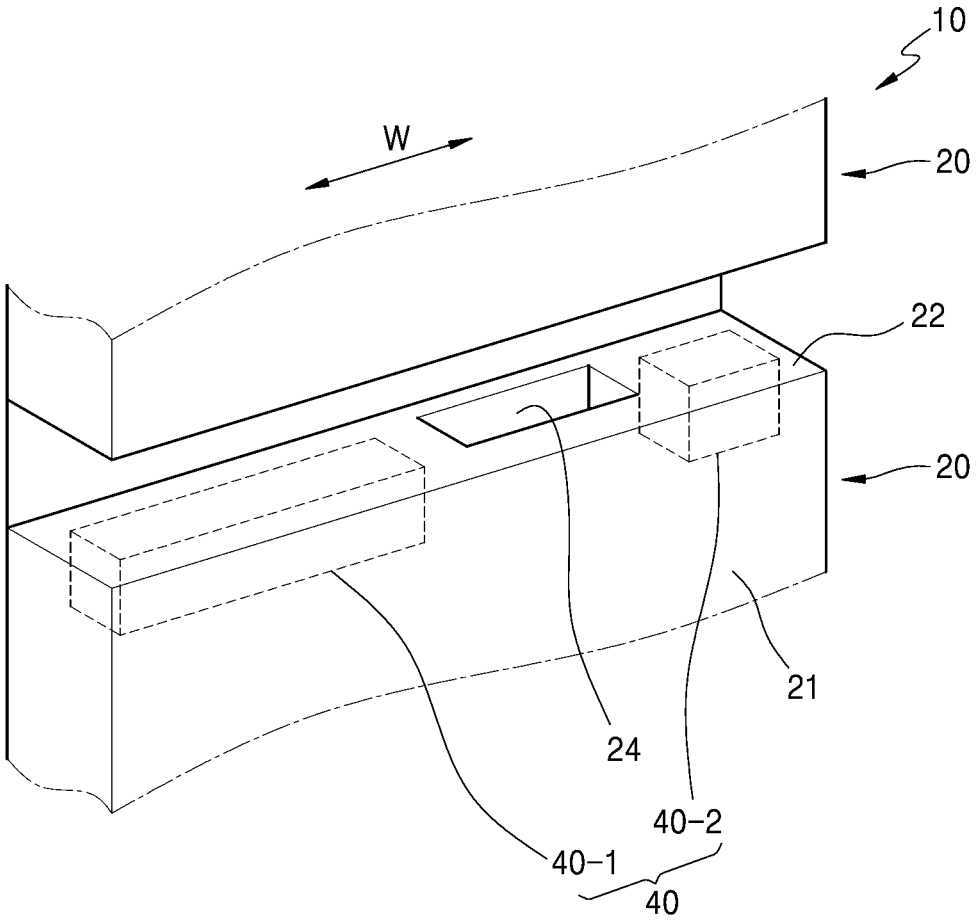
FIG. 9 is a schematic partial perspective view of an embodiment of a refrigerator.

FIG. 9 is a schematic partial perspective view of an embodiment of the refrigerator 100. Referring to FIG. 9, for example, a recess 24 for installing a handle or hanging a hand may be installed in at least one location in a width direction W of the door 20. For example, the decorative panel 22 forming an upper surface portion of the door 20 may be provided with the recess 24 immersed downward. Even with this type of door 20, the outside air heat inductor 40 may be arranged divided into a plurality of pieces and arranged in the width direction W of the door 20, so that sufficient outside air heat may be transmitted to be a surface of the cabinet 10. In other words, the outside air heat inductor 40 may include a plurality of division elements, for example, first and second division elements 40-1 and 40-2, arranged spaced apart from each other in the width direction W of the door 20. The recess 24 may be arranged between the first and second division elements 40-1 and 40-2. In other words, the plurality of division elements 40-1 and 40-2 that divide the outside air heat inductor 40 in the width direction W are installed at a location away from the recess 24 in the width direction W of the door 20, thereby guaranteeing an amount of heat transferred to a surface of the cabinet 10.

Referring again to FIG. 2, the outward-facing surface (or end) 40*a* of the outside air heat inductor 40 may have a shape according to a surface exterior facing the outside of the door 20, that is, the front portion 21 of the door 20. In addition, an inward-facing surface (or end) 40*b* of the outside air heat inductor 40 may have a shape according to a door liner 25 facing the inside of the door 20. According to this configuration, the outside air heat inductor 40 may be disposed with no gap or almost no gap with respect to the surface exterior of the door 20 and the door liner 25, so that outside air heat may be efficiently transferred to a surface of the cabinet 10 and displacement of the outside air heat inductor 40 may also be prevented.

In addition, in the embodiment described above, as shown in FIG. 3, a manufacturing method of attaching the outside air heat inductor 40 to the decorative panel 22 forming the door 20 is illustrated, but the outside air heat inductor 40 may be formed integrally with the decorative panel 22.

In addition, the outside air heat inductor 40 does not necessarily have to have the intermediate support member 43. For example, as shown in FIG. 5, in an embodiment in which the first heat transfer path forming member 41 and the second heat transfer path forming member 42 are connected and integrated by the connection member 44, the intermediate support member 43 may be omitted. In this case, an air layer may be interposed between the first heat transfer path forming member 41 and the second heat transfer path forming member 42. According to this configuration, the intermediate support member 43 may be omitted, thereby reducing a cost by reducing the number of components.

In addition, either or both of the first heat transfer path forming member 41 and the second heat transfer path forming member 42 are not necessarily limited to the metal foil, and may be formed of a metal plate or the like having a certain thickness.

In addition, the refrigerator 100 of the disclosure may not have a structure in which a cooling unit is accommodated within the cabinet 10, but may have a structure in which cold air is supplied to the cabinet 10 from a cooling unit disposed apart from the refrigerator 100. In this cooling structure, there are cases in which placing a hot pipe near the condensation generating portion is not realistic, and thus, when the outside air heat inductor 40 according to the embodiments described above is applied, the outside air heat inductor 40 may be very effective in preventing condensation.

The disclosure is not limited to the embodiments described above, and various modifications are possible without departing from the spirit of the disclosure.

The invention claimed is:

1. A refrigerator comprising:

a cabinet;

a door configured to open and close an opening of the cabinet; and an outside air heat inductor arrangeable inside the door to extend toward the cabinet from a front portion of the door, wherein the outside air heat inductor comprises:

a first heat transfer path forming member configured to transfer outside air heat from outside the refrigerator toward a surface of the cabinet; and a second heat transfer path forming member arrangeable between the first heat transfer path forming member and an inside of the cabinet such that while the second heat transfer path forming member is arranged between the first heat transfer path forming member and the inside of the cabinet, the second heat transfer path forming member receives the outside air heat and prevents cold air within the cabinet from being transferred to the first heat transfer path forming member.

2. The refrigerator of claim 1, wherein the first heat transfer path forming member and the second heat transfer path forming member are inside the door and extend toward the cabinet from the front portion of the door.

3. The refrigerator of claim 1, wherein at least one of an upper surface portion and a lower surface portion of the door comprises a decorative panel, and the first heat transfer path forming member is in contact with an inner surface of the decorative panel.

4. The refrigerator of claim 1, wherein an end of the second heat transfer path forming member near the inside of the cabinet is located between the inside of the cabinet and the first heat transfer path forming member.

5. The refrigerator of claim 1, wherein the outside air heat inductor further comprises one or more third heat transfer path forming members arrangeable between the first heat transfer path forming member and the second heat transfer path forming member to extend toward the cabinet from the front portion of the door.

6. The refrigerator of claim 1, wherein the outside air heat inductor further comprises an intermediate support member interposed between the first heat transfer path forming member and the second heat transfer path forming member and supporting the first heat transfer path forming member and the second heat transfer path forming member.

7. The refrigerator of claim 6, wherein the outside air heat inductor comprises a fourth heat transfer path forming member covering at least a portion of surfaces of the intermediate support member other than surfaces on which the first heat transfer path forming member and the second heat transfer path forming member are supported.

8. The refrigerator of claim 1, wherein at least one of an upper surface portion and a lower surface portion of the door comprises a decorative panel, the first heat transfer path forming member is in contact with an inner surface of the decorative panel, and thermal conductivities of the first heat transfer path forming member and the second heat transfer path forming member are higher than a thermal conductivity of the decorative panel.

9. The refrigerator of claim 1, wherein thicknesses of the first heat transfer path forming member and thicknesses of the second heat transfer path forming member is 10 μm or more and 5 mm or less.

10. The refrigerator of claim 1, wherein a resin passing hole through which foamed resin filling the door passes is in the second heat transfer path forming member, and the foamed resin fills between the first heat transfer path forming member and the second heat transfer path forming member.

11. The refrigerator of claim 1, wherein the first heat transfer path forming member and the second heat transfer path forming member are integrally formed.

12. The refrigerator of claim 11, further comprising:

a connection member to connect the first heat transfer path forming member with the second heat transfer path forming member, and wherein the connection member connects ends of the first heat transfer path forming member and the second heat transfer path forming member near the front portion of the door.

13. The refrigerator of claim 1, wherein the outside air heat inductor is divided into a plurality of pieces, and the plurality of pieces are arranged to be spaced apart from each other along a width direction of the door.

14. The refrigerator of claim 1, wherein an outward-facing surface of the outside air heat inductor has a shape according to the front portion of the door, and an inward-facing surface of the outside air heat inductor has a shape according to a door liner of the door facing the cabinet.

15. The refrigerator of claim 1, wherein an air layer is between the first heat transfer path forming member and the second heat transfer path forming member.

* * * * *